US005323855A

United States Patent [19]

Evans

[11] Patent Number: 5,323,855

[45] Date of Patent: Jun. 28, 1994

[54] WELL STIMULATION PROCESS AND APPARATUS

[76] Inventor: James O. Evans, 2739 Beech La., Pampa, Tex. 79065

[21] Appl. No.: 19,155

[22] Filed: Feb. 17, 1993

Related U.S. Application Data

[63] Continuation-in-part of Ser. No. 701,770, May 17, 1991.

[51] Int. Cl.[5] ..... E21B 43/24

[52] U.S. Cl. ..... 166/248; 166/66.5

[58] Field of Search ..... 166/248, 304, 65.1, 166/66.5

[56] References Cited

U.S. PATENT DOCUMENTS

| | | |
|---|---|---|
| 849,524 | 4/1907 | Baker . |
| 2,472,445 | 6/1949 | Sprong . |
| 4,046,194 | 9/1977 | Cloud . |
| 4,373,581 | 2/1983 | Toeliner . |
| 4,466,484 | 8/1984 | Kermabon . |
| 4,495,990 | 1/1985 | Titus . |
| 4,538,682 | 9/1985 | McManus . |
| 4,579,173 | 4/1986 | Rosensweig . |
| 4,630,862 | 1/1987 | Savage . |
| 4,716,960 | 1/1988 | Eastlund . |
| 4,926,941 | 5/1990 | Glandt . |
| 5,065,819 | 11/1991 | Kasevich . |

FOREIGN PATENT DOCUMENTS

| | | |
|---|---|---|
| 2938998 | 1/1981 | Fed. Rep. of Germany . |

*Primary Examiner*—William P. Neuder
*Attorney, Agent, or Firm*—Head & Johnson

[57] ABSTRACT

An apparatus to extract electromagnetically susceptible fluids and electromagnetically susceptible particles from a subterranean well having a shaft or tube extending from the surface to a fluid-containing formation and a mechanism to deliver the fluids and particles to the surface from the fluid-containing formation. The apparatus includes at least one electromagnetical coil within the shaft or tube. A direct current is supplied to the electromagnetic coil to generate a electromagnetic field in the fluid-containing formation. The magnetically susceptible fluids and particles are attracted toward the shaft tube through use of the electromagnetic field.

7 Claims, 7 Drawing Sheets

Fig. 3
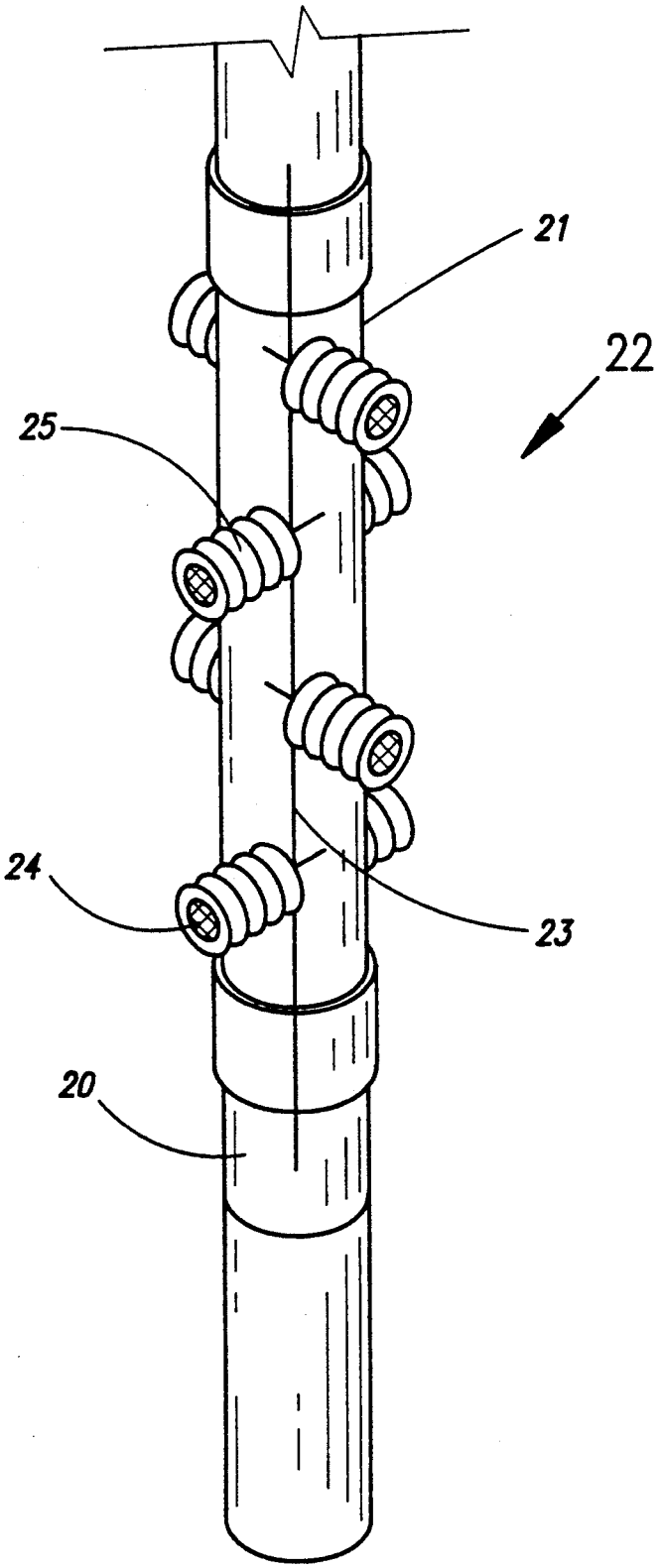
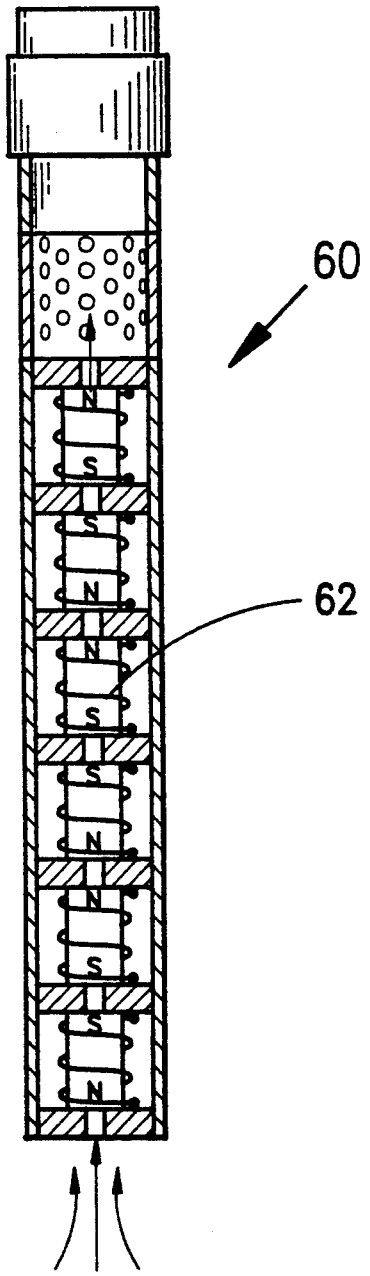
Fig. 9

WELL STIMULATION PROCESS AND APPARATUS

CROSS REFERENCE OF APPLICATION

This application is a continuation-in-part of U.S. patent application Ser. No. 07/701,770, filed May 17, 1991, entitled "Electromagnetic Coil Process and Apparatus for Well Stimulation".

BACKGROUND OF THE INVENTION

1. Field of the Invention

The present invention is directed to a process and apparatus to extract residual hydrocarbon oil that is trapped in the formations of underground reservoirs.

2. Prior Art

While North American reservoirs still hold a third of a trillion barrels of hydrocarbon oil, the easier-to-produce oil in North America is almost gone even with current advanced reservoir-enhancement capabilities. Most of what remains is oil which resists extraction. The challenge is to overcome the Earth's natural resistant forces that are immobilizing the hydrocarbon oil and to realign the forces acting on the oil while it is in the earth and thus make it easier to extract from the reservoir.

The Earth's geomagnetic field; its plasma and colloid state; its minerals and rocks; formation waters, residual oil, and reservoir characteristics—all of these mechanical and physical properties act and react to electric and magnetic forces which tend to hold residual oil captive.

The Electric and Magnetic Environment: Earth

The Earth is surrounded by a magnetic field within which it behaves as if it were a magnetized ball with north and south magnetic poles.

Carl Friedrich Gauss published *Allegemeine Theorie des Erdmagnetismus* in 1838. In his mathematical analysis, Gauss showed that more than 95 percent of the Earth's magnetic field originates within the Earth's interior, and only a small remaining portion comes from outside sources.

The Earth's magnetic field results from electric currents which generate electric charges within the Earth's core. That portion of the Earth's magnetic field produced by outside sources is related to electromagnetic activities in the Earth's upper atmosphere. The primary outside source produces a flow of electric current in the Earth's electrically conductive interior by a process of electromagnetic induction. Daily geomagnetic variations are attributable to the transient electric currents that are electromagnetically induced within the Earth's interior by the primary magnetic field variations of the outside sources. The Earth's electric and magnetic fields are affected by external factors such as the effect of this induced current. The Earth's magnetic field is gradually changing with time in its intensity as well as in its distribution pattern. These changes affect the characteristics of subsurface minerals, rocks and fluids.

There are five mechanical properties of the earth's body that are fundamental to the determination of its behavior-density, pressure, gravitational intensity, incompressibility and rigidity. Density refers to mass per unit volume, which varies within the earth because of the effects of pressure and temperature and because of variations of composition. Pressure refers to the force per unit area inside a body, and incompressibility indicates the extent to which a material resists pressure.

Rigidity indicates the resistance of a material to the stresses that tend to distort it, and gravitational intensity is the force per unit mass arising from a gravitational field.

Minerals and Rocks

When the earth "cooled" from its believed-to-be original state, the ions responded to their electrical attractions and bonded together in the fixed positions of solids. All the element were present in this original molten matter, but oxygen, silicon, iron and magnesium made up 90 per cent of the total. Sodium, aluminum, potassium and calcium were also present in significant amounts.

One of the first combinations of elements formed was a four-sided structure with four oxygen atoms around one silicon atom, the silicon-oxygen tetrahedron; it is the basic unit in 90 percent of the materials of the earth's crust. Electrically conducting clays contain this tetrahedron. Electrically conducting and magnetically susceptible iron is the most abundant element in the earth and the fourth most abundant in the earth's crust (after oxygen, silicon and aluminum). Most sedimentary rocks contain iron as a cementing or accessory mineral in the form of carbonates, hydrated silicates, oxides, hydroxides and sulfides.

Historically, the first logging measurement, the spontaneous potential, was a measurement of the electrical currents that occur in the wellbore when fluids of different salinities are in contact. Well logs can determine many of the various physical properties of the rocks penetrated by the wellbore. One of the most useful of these properties is electrical resistivity. Electrical resistivity can be defined as the degree to which a substance "resists" or impedes the flow of electrical current. It is a physical property of the material, independent of size or shape. Low resistivity corresponds to high conductivity; high resistivity corresponds to low conductivity.

Minerals containing iron, manganese and the common magnetic mineral magnetite have large susceptibilities to magnetization and are called ferromagnetic. For these materials, the individual ion particles align themselves spontaneously to produce a magnetization even in the absence of an inducing magnetic field. The application of a magnetic field by an electromagnetic coil causes progressive reorientation of the magnetic domain, including a net magnetization so large that the magnetic susceptibility of the rock formation is dominated by its content of ferromagnetic minerals even though these are present only as minor constituents. Rocks of higher than normal magnetic susceptibility beneath the earth's surface tend to enhance the earth's magnetic field locally in the same way that an iron core enhances the field of an electromagnet.

Reservoir rocks containing ferromagnetic minerals have acquired a residual magnetization which results from the magnetization of the individual grains. Upon cooling at the earth's surface these minerals became strongly magnetized in the direction of the surrounding earth's magnetic field. This magnetization is very stable and subsequent exposure of rocks with this residual magnetization to magnetic fields several order of magnitude stronger than the magnetizing field cannot appreciably change the original magnetization. Magnetization is also acquired by isothermal, chemical, and viscous residual magnetization. Electrically charged formation fluids will be held in a static state in formation rock having residual magnetization.

Solids, Liquids and Gases

Formation solids and formation fluids display a wide range of magnetic behavior or magnetic susceptibility. Different susceptibilities respond differently to an external magnetic field.

The chief molecule in many clays is composed of a single silica tetrahedron which will cause these clays to act as conductors which will contribute to their conductivity in a water-saturated porous formation. When the clay is hydrated, the absorbed ions of the clay form an ionic conductor.

Non-ionic formation fluids, which includes some of the hydrocarbons of the reservoir, composed of molecules that do not dissociate into ions and have negligible conductivities, but they tend to be polarized by a magnetic field. The fluid develops positive and negative poles and also a dipole moment, from which the fluid acquires energy. This partial alignment occurs in a field whose frequency is less than the reciprocal of the time it takes the polar molecule to rotate. The static and dynamic processes associated with the motion and pressure distribution induced in magnetically polarized formation fluids when in the presence of an appropriate field gradient is known as ferrohydrodynamics.

Viscosity of a fluid is a measure of its ability to resist deformation when subjected to stress. Viscosity is concerned with the transfer of momentum, and diffusion is concerned with the transport of molecules in a mixture. Diffusion rate in solids is extremely small, and diffusion rates in liquids are much smaller than those in gases.

Crystals of polar symmetry are little altered by external influences. Certain materials, especially paraffin-containing polar molecules, exhibit similar and more controllable effects and are known as electrets. If a molten dipolar paraffin is subjected to a strong electric field, it becomes polarized. Since paraffin is a good insulator and is hydrophobic, this relatively weak frozen-in polarization will persist and remain unaffected by surface charges. This is one form of electret, the electrical equivalent of a permanent magnet. The electret gives a method of maintaining a static electric field over long periods. Formation fluids would be unable to move in this static field unless the fluids molecules were attracted by a magnetic force of greater potential, such as results from the present invention.

A static condition exists in the reservoir at the point that the mechanical, physical and the earth's electric and magnetic forces are equal to or greater than the formation pressure, causing the movement of the formation fluids to wellbore to stop. This electrostatic force combines with the physical and mechanical properties of the reservoir to resist the movement of formation fluids. The present invention acts to cause flow of fluids to the wellbore to resume.

SUMMARY OF THE INVENTION

The present invention describes an apparatus and a method to extract hydrocarbon oil or other fluids which are trapped in subterranean reservoirs, and which cannot be readily removed by conventional means. The apparatus utilizes one or more electromagnetic coils which are centrally located in a wellbore hole which is positioned in a portion of a subterranean fluid-containing formation called the payzone from which it is desired to extract hydrocarbon or other fluids. It is a purpose of the present invention to increase the recovery of hydrocarbon and other fluids from hydrocarbon bearing deposits using electromagnetic attraction.

The process and apparatus include one or more electromagnetic coils which are attached to a centrally located shaft or tube which is inserted into or is part of an oil (or other liquid producing) well. These electromagnets generate a magnetic field which extends radially from the tubing of a subterranean oil (or other fluid) well. These coils are energized with direct current, which results in a strong attraction of magnetic particulate matter and fluids towards the central tubing. Electric current may be supplied intermittently to the coils, thereby jolting the particulate matter and speeding its flow.

The direction of the electrical current to the coils can be periodically reversed. Particulate matter given one charge will then be subject to an opposing charge, which speeds up movement to the wellbore. Particulate matter, in moving to the wellbore, will carry along hydrocarbon or other fluid, thereby causing fluid flow to the wellbore to increase.

In one variation of this invention, a vibration sensitive transistor is inserted into the electrical circuit in order to cause the vibrations of the oil well pump to generate some electricity which can be used to power the magnets.

In another variation, a capacitor is inserted in the electrical circuit to provide bursts of electricity to the magnets in order to stimulate fluid flow.

BRIEF DESCRIPTION OF THE DRAWINGS

FIG. 3 is an enlarged schematic view of one preferred version of the electromagnetic coil apparatus of the present invention.

FIG. 9 is a further, alternate embodiment of the present invention.

DETAILED DESCRIPTION OF THE PREFERRED EMBODIMENTS

Figure 1:
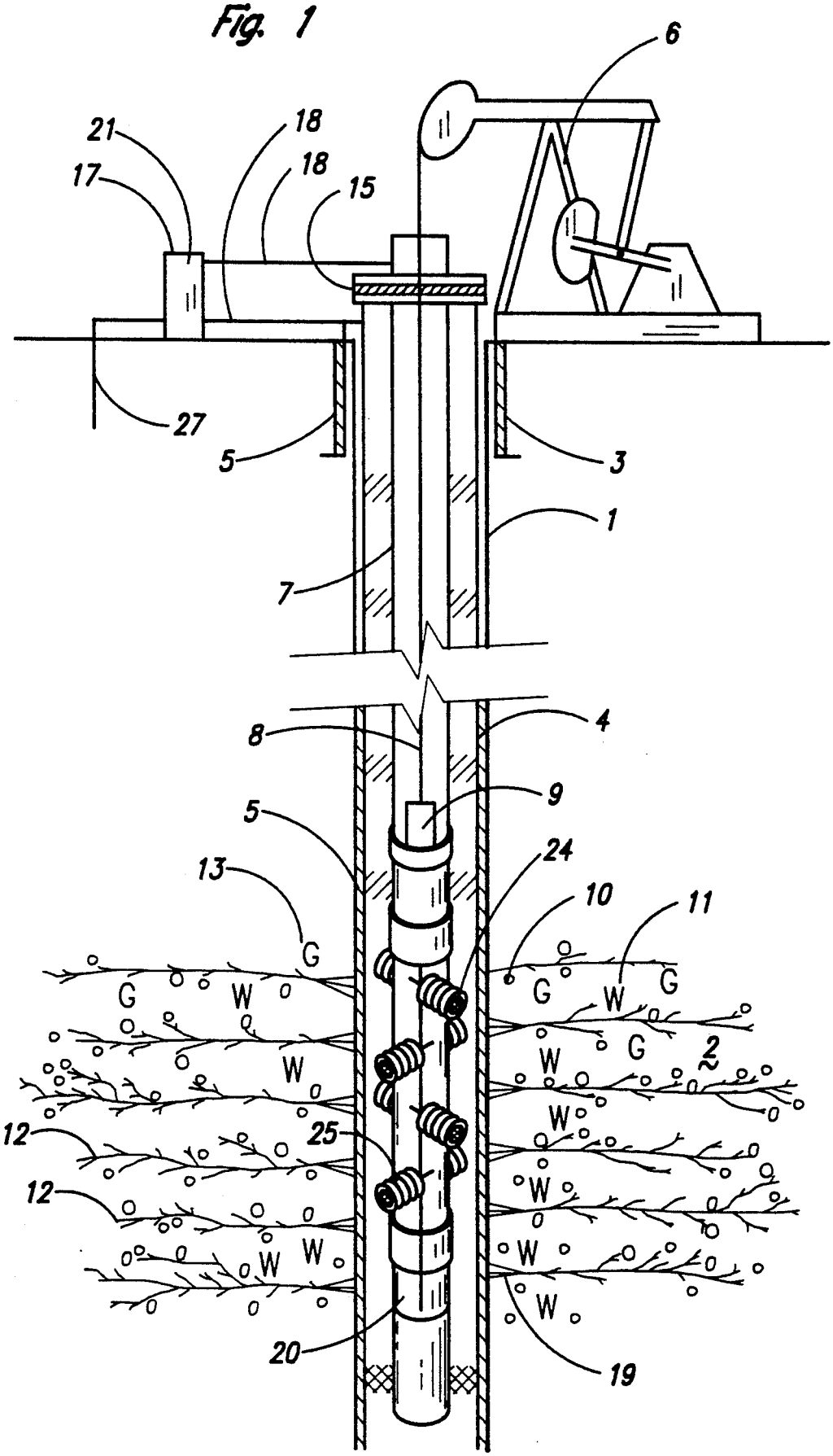
FIG. 1 is a sectional and schematic elevation view of a wellbore, well equipment and the electromagnetic coil apparatus of the present invention.

Referring to the drawings in detail, FIG. 1, a wellbore 1 is drilled to a fluid-containing formation or payzone 2 in the reservoir which is productive of hydrocarbon oil 10 and/or gas 13. Metal surface casing 3 may be installed near the surface of the earth. A metal casing 4 is cemented 5 in the wellbore 1 to protect the wellbore. A pumping unit 6, with tubing 7, rod 8 and pump 9 or a similar fluid recovery device may be installed to aid in bringing liquid hydrocarbon or other liquids to the surface.

Referring to FIG. 1, hydrocarbon reservoirs may consist of subterranean rock formations where oil 10 and gas 13 have accumulated in sufficient quantities to be of commercial value.

Initially, a reservoir has a certain amount of potential energy in the form of pressurized fluids and gas. This potential energy is depleted as fluids and gas 13 move to the wellbore 1 and exit the formation until eventually insufficient pressure remains causing oil 10 flow (oil production) to drop below economic levels. As the reservoir pressure decreases, fluid surface tension also changes.

In the period following the drilling of an oil well, certain factors occur which result in the amount of oil which is extracted from the well to decrease. Oil production may eventually decrease to a point where it is uneconomical to continue well operation. It is generally believed that about 60 percent of the hydrocarbon fluid 10 originally located in payzone 2 is not easily recovered. Formation water 11 may move into the pores and fractures, thereby preventing the oil 10 from exiting the payzone 2. Solids may also enter the pore and fractures and block the oil 10 from leaving the payzone 2.

Figure 2:
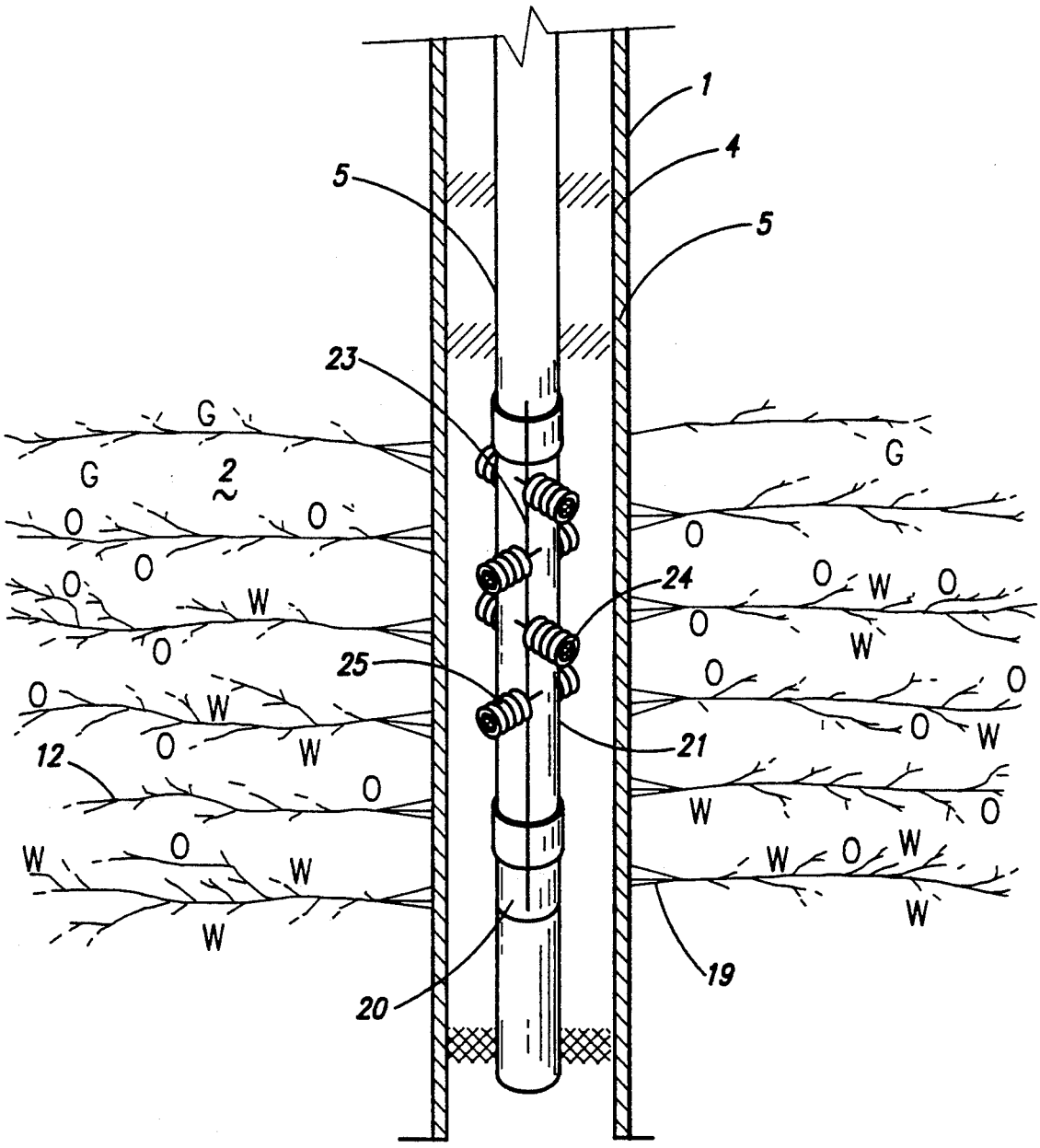
FIG. 2 is a sectional view of the electromagnetic coil apparatus positioned within the well's payzone.

As shown in FIG. 2, the installation of the electromagnetic coil apparatus 22 in a low-productive well will cause formation fluids 10 to move towards and enter the wellbore 1. The use of electromagnetic coils 25 will cause magnetically susceptible solids to move toward the wellbore, bringing along with the solids and hydrocarbon fluids.

If the electromagnetic coil and apparatus 22 is installed in a new well, the benefits of this process will prevent many of the deleterious effects on the oil bearing formation or payzone 2 which have been previously described. This will prevent oil flow from decreasing as much as in the usual case.

Oil 10 and gas 13 occupy the smallest portion of the reservoir's pore structure; the main component is formation water 11. Formation water 11 contains very large amounts of dissolved solids; the amount of dissolved solids increases as the age and dept of the formation increases.

Reservoirs contain an intimate mixture of colloidal solids, metals, clays, shales, oil and formation water. Each of these components has varying magnetic susceptibilities, and will react differently to magnetic flux.

Referring to FIG. 2, hydrocarbon oil 10 moves through pores and fractures 12 in fine, thread-like channels. Formation water 11, squeezed out of shale, carries oil 10 through the reservoir formation as a colloidal emulsion of oil 10 and water 13. If this emulsion moves from coarse-grained to fine-grained rock, oil will precipitate out at the rock interface.

The specific gravity of oil, being less than water, should allow oil 10 to be forced upward out of the formation by displacing of formation water 11; however, capillary action retains oil in the pores.

As a result of these and other factors, oil 10, which can be initially driven out of rock formations with water 11, is not readily driven out after the rock becomes saturated with water.

Referring to FIG. 2, it has been found that electrical energy applied to one or more electromagnetic coils 25 having metal cores 24, placed in a wellbore 1, which is in the payzone (a liquid hydrocarbon bearing formation) 2, will cause the flow of fluids to the wellbore to increase.

The magnetic flux of the electromagnetic coil apparatus will cause fluid flow to increase when the natural forces of formation water displacement of the oil 10 cease to be effective.

The effects of a pulsating magnetic field 26 on a susceptible ferromagnetic substance are important. The mechanism deformation that occurs when a substance is magnetized is termed magnetostriction. If the electrical current supplied to an electromagnet alternately completes and breaks the electrical circuit which energizes the electromagnetic coils 25 or if the direction of flow of electric current to these coils is alternately reversed, the fluid flow to the wellbore 1 is enhanced. In the pores and fractures 12 of the ferromagnetic minerals and rocks rests the electrolyte formation water 11 of the reservoir.

FIG. 3 illustrates an enlarged view of one embodiment of well stimulation apparatus.

Recently it has been discovered that there is a common electrical conducting layer of asphalt at the oil-water contact in many places on Earth. At Hawkins, Tex. and Prudhoe Bay, Ak., the layer is 20 to 30 feet thick. In other cases, it is much thinner. In Saudi Arabia, it has been recognized on the electric logs. In wellbores 1 where this asphalt layer is present, the electromagnetic field created by the apparatus is strengthened, resulting in increased fluid flow.

Figure 5:
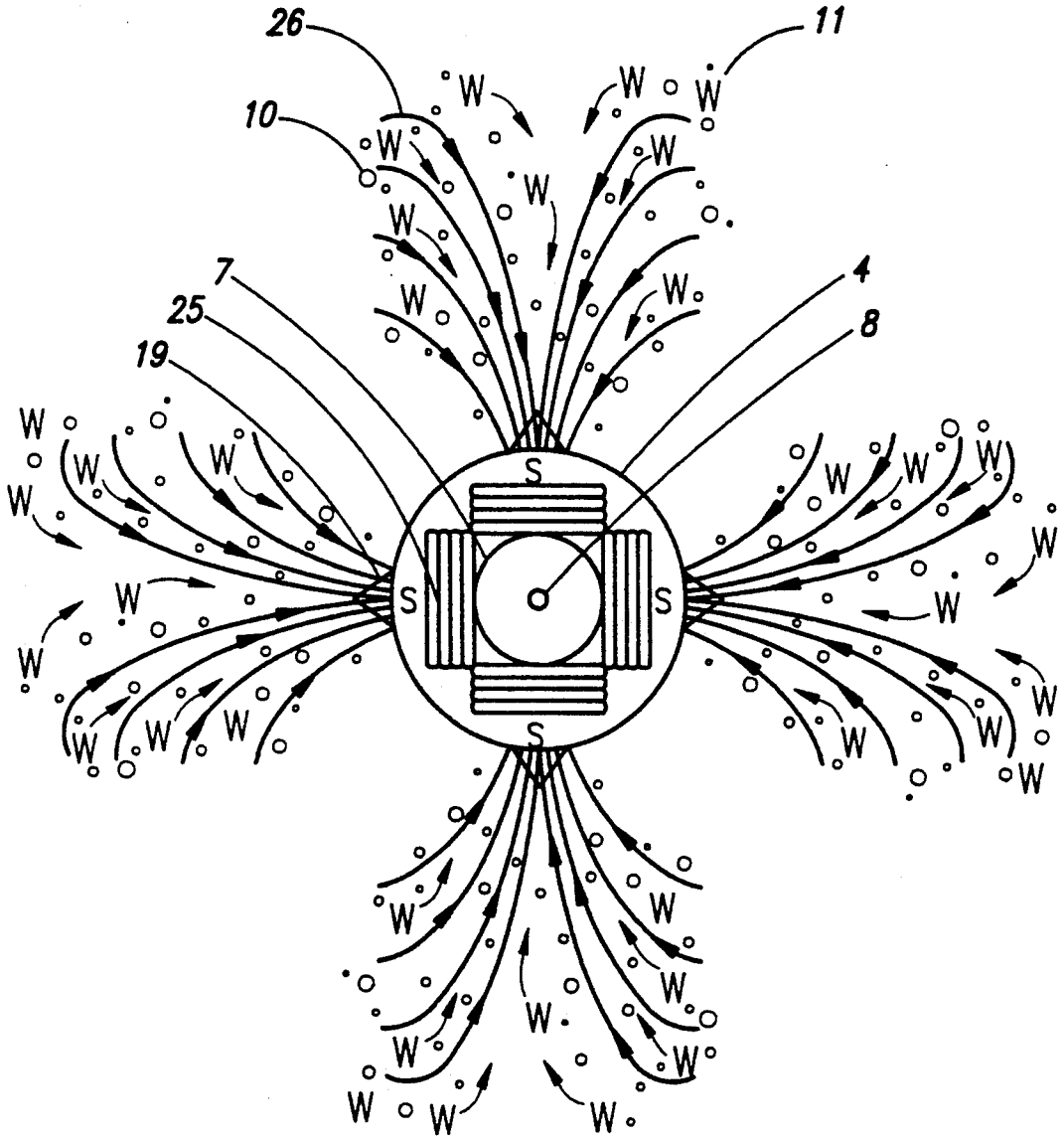
FIG. 5 is a diagrammatic top view of the formation fluids being attracted to the south poles of the electromagnetic coils in the wellbore.

Referring to FIG. 5, the fluids in a reservoir are plasma. A plasma is an electrically conducting medium, whose electrical properties depend on the collective behavior of the particles. A plasma obeys the laws of magnetohydrodynamics in the presence of magnetic or electric fields.

The basic properties of a plasma are determined primarily by the laws of conservation of energy and momentum and by the behavior of the plasma electrons. Electrons moving in magnetic fields strengthen the fields. Plasma characteristics depend on electrical resistivity of the plasma and the velocity of the particles. When the "magnetic Reynolds number" is much greater than one, resistance effects can be ignored and the magnetic lines of force are said to move with the plasma. Because of this phenomenon certain types of waves called magnetohydrodynamic waves occur at low frequencies. In a wave, the plasma particles oscillate about an equilibrium position and their energy and momentum are transferred from one to another either by collisions or by interaction with electric and magnetic fields.

Figure 4:
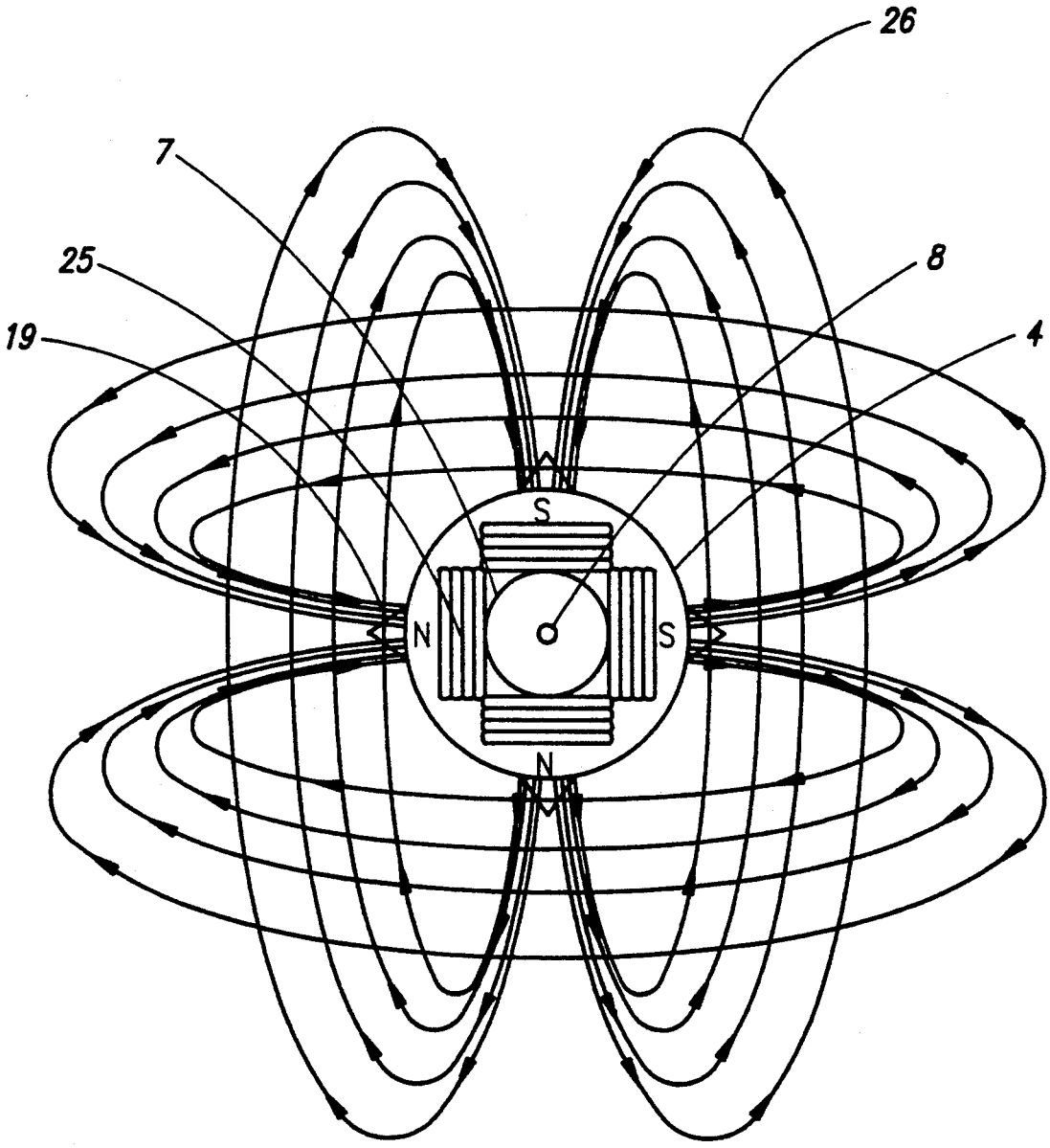
FIG. 4 is a diagrammatic top view (two sets of electromagnetic coils) of the magnetic field of the present invention.

For magnetohydrodynamic transverse and longitudinal waves, the plasma behaves as a whole and the wave speeds are independent of wave frequency when the frequency is low. Magnetic pulses will be transmitted in the electrolyte plasma formation water 11 and attract and move the formation fluids with their dissolved solids to the wellbore (FIG. 4).

Colloids

Oil and water emulsions carry an electric charge, each particle in a given system having the same charge. It is to this charge that hydrocarbon emulsions and colloids owe their stability and high electrical conductivity. Oil and water are immiscible. As oil 10 and formation water 11 move through the reservoir, they frequently form dispersions in which small droplets of one liquid are suspended in the other.

When emulsifying agents, mild acids, iron sulfide or clays are present with oil 10 and formation water 11 in the formation, droplets can form which have an internal phase completely surrounded by outer layers of the other liquid and the emulsifying agent. Plugging or restrictions of the formation may occur due to the presence of emulsions in the pores and fractures 12 of the formation.

When these emulsion droplets are subjected to magnetic pulses of one charge or with alternating charges they tend to attract each other. As the droplets collide and coalesce, they combine and become large enough to settle to oil and water layers. The ability of liquids, especially water, to dissolve solids, other liquids or gases has long been recognized as one of the fundamental phenomena of nature.

Referring to FIG. 1, wettability of the liquid bearing formation or payzone 2 is a factor in emulsion stability. As more water wet fines are drawn into the drainage area the stability of the emulsion decreases. A small water saturation gives a greater capillary pressure. As the amount of water that is held by capillary forces and earth forces increases, the permeability decreases. As the movement of fluids are increased toward the wellbore 1, capillary forces will decrease and the permeability will increase. The electromagnetic coil process and apparatus will increase the movement of fluids to the drainage area and then to the wellbore 1. Electricity is the phenomenon associated with positively and negatively charged particles of matter and plasma at rest and in motion.

An electric current flowing along a wire generates a magnetic field in the space around the wire. The field can be made stronger by winding the wire into a coil of many turns and can be concentrated in space by filling the volume inside the coil with a metal core, thus creating a device known as an electromagnet, in which the magnetic field can be controlled by adjusting the size of the current flowing in the coil.

When placed in a magnetic field, a wire carrying an electric current experiences a mechanical force. Powerful magnetic forces can be generated by comparatively small devices and can be conveniently controlled by adjustment of the size of the current.

When a coil of wire is situated in a magnetic field that is increasing or decreasing, an electrical voltage proportional to the rate of change of the field is created in the coil. This is the phenomenon known as electromagnetic induction.

An important relationship about these electromagnetic waves at all points in their propagation is called the right-angle relationship: the direction of the electric field, the direction of the magnetic field and the direction in which the combined field or wave is instantly moving are always at right angles to each other. The effect of these waves generated by the electromagnetic coil apparatus o oil particles with high magnetic susceptibility is to increase the flow of the oil to the wellbore.

Magnetically susceptible colloids in the formation water 11 and in the conducting channels, pores and fractures 12, will respond to the magnetic field and will push and pull the formation fluids in the reservoir to the wellbore 1. By intermittently making and breaking the current to the electromagnets 25, or by the alternately reversing polarity of the field between north and south or east and west, the particles are jolted and fluid flow to the wellbore is enhanced.

Electric current is always surrounded by a magnetic field 26 as best shown in FIGS. 4 or 5. The field of a straight wire is weak but becomes stronger by coiling the wire into a loop. Winding a number of loops onto a coil and passing electric current through the loops, the magnetic field about each turn will have the same direction and each loop will contribute to the total field intensity at the center. Referring to FIG. 3, the strength of the magnetic field of the electromagnetic coil 25 can be increased by increasing the coil loops, or the coil cross-section or length or by choice of core materials.

With current flowing through the electromagnetic coil apparatus 22 in the wellbore 1, in FIG. 4 the strong magnetic lines of force 26 will leave the coils 25 at the north-seeking pole, forming closed spherical arcs through the formation fanning out and joining the south-seeking pole of the coil, thereby creating a magnetic spherical field and attracting the magnetic particles of the formation fluids of the reservoir to the wellbore 1.

Molecules-Electron Movement

In a static state between the formation fluids and the formation solids, the fluids stay in place in the reservoir, aided by capillary attraction caused by surface tension and by the adhesive forces between formation fluids and solids. To induce movement of the molecules, these static forces must be overpowered. Referring to FIG. 1, electromagnetic forces induced in the wellbore 1 will attract and move the molecules of the formation fluids to the wellbore 1. This movement will increase kinetic energy; as the kinetic energy increases, intermolecular cohesion decreased and there is an increase in the repelling force between the molecules of the fluids causing a resistance to compression and the fluids will move to the point of the lower pressure—the wellbore 1.

Formation water 11 which occupies the pores and fractures 12 and the irregular and finest pore structures of the formation, will be attracted by the electromagnetic coil 25 in apparatus 22 as shown in FIG. 3. This attracting force will move other formation fluids that are commingled with or ahead of the formation water 11 to the wellbore 1. Residual oil 10 will be moved, pushed or dragged to the wellbore 1.

One of the necessary characteristics of a petroleum reservoir is its ability to allow the movement of formation fluids through it. Darcy's Law has been used as an expression of flow into a wellbore from a surrounding reservoir.

The analogy of fluid flow in reservoir formations to electrical flow is well known. Darcy's Law for linear flow and Ohm's Law for electrical flow are respectively:

$$Q=(k)\,(A)\,(P/L)\quad I=E/R$$

where Q is equal to fluid flow rate, A is equal to cross-sectional flow area, P is equal to pressure, L is equal to the length of flow, I is equal to electrical current flow, amps, E is equal to electromotive force, volts and R is equal to electrical current resistance, ohms, and k is equal to a constant.

The driving forces P and E and the flow quantities Q and I are analogous indicating that the term (kA/L) can be treated in much the same way as is R in an electrical circuit.

Applying the electrical laws for resistances in series and parallel circuits to fluid flow gives equivalent expressions for fluid flow in beds lying in series and parallel.

In an electrical system the total resistance R is dependent upon the type material and the geometry of the conductor, the same as fluid flow.

For fluid flow in systems where the geometry is not linear there is a correspondence between Darcy's law and Ohm's law; fluid flow is similar to electric current.

Pressure in liquid flow and voltage in electrical current flow are analogous and may be termed "potential".

In a system where there is a variation of potential, flow can occur between any two points over which a potential difference exists provided there is no impermeable barrier of separation. Between two points where the potentials are identical, no flow occurs. These two points then lie on a equipotential line.

Although flow may occur between any two points not on a common equipotential line, fluid or particles will not necessarily move between any two such points in a system. The direction of flow a particle will take is governed by the relative amount of potential differences.

It is a general principle that flow through a system will be in the direction in which the potential gradient is a maximum. A fluid particle, therefore, always moves in a direction at right angles to the equipotential line on which it rests because the gradient is a maximum in the perpendicular direction. The path that a given fluid particle follows as it moves through the system is called the flow line. Just a the spacing between equipotential lines indicates a changing gradient so the divergence or convergence of flow lines indicate a decrease or increase in flow capacity.

The idea of flow direction at right angles to equipressure lines can be applied to the movement of formation fluids within a reservoir.

A given particle is assumed to move along its flow line in proportion to the pressure gradient along the flow line. Referring to FIG. 5, the electromagnetic coils 25 will attract, pull and drag magnetic particles which will cause the formation fluids of the reservoir to move to the wellbore 1. The formation fluids that were thought to be unrecoverable can now be moved to the wellbore 1 to be captured by the fluid recovery equipment. A large portion of the petroleum that had been held in the reservoir will be recovered.

The factors that will influence the design of the apparatus 22 (FIG. 3) will vary dependent on the well. The factors that must be considered in determining the electric and magnetic fields 26 of force that will be required are: 1) the type of formation and formation fluids, 2) the type of well completion, 3) the resistance of materials in the electric circuit, 4) and the design, construction and materials of the electromagnetic coils 25. Selection of the magnet core 24 material is very important because this affects the strength of the field.

The apparatus 22 (FIG. 3) consists of a number of coils 25 that are placed in a horizontal position on a tubing 7 section of the production tubing 7 located in the wellbore 1, FIG. 2. The tubing 7 section of the apparatus 22, being below the production pump 9, may be the same size as the production tubing 7 or smaller in order to accommodate the largest-sized coils. In one version of the invention, the coils 25, having a metallic core 24 may be attached to the section of tubing 7 as shown in FIGS. 1 and 2 and can be centered at 90 degree intervals around the tubing 7. The coils 25, which may vary in shape, are rounded or vertically or horizontally elliptical and positioned on tubing 7, and will be connected to the electric circuit in either a series or parallel arrangement, depending the magnetic field requirements. The closer the north and south poles are to each other, the stronger the flux of the coils 25.

In a variation of the invention, the cores of the electromagnetic coils are positioned vertically and parallel to tubing 7. The apparatus 22 magnetic flux field 26 (FIG. 4) is established by placing the electromagnet's cores 24 opposite each other on the tubing 7 section of the apparatus 22, with the wire 23 of the coils 25 wound in such a manner and current direction such that outward facing magnet poles are of opposite signs, i.e., north and south, on opposite sides of the tubing 7. The coils 25 are placed on the tubing 7 in this manner and spaced to cover the perforated 19 payzones 2 in the wellbore 1. Referring to FIG. 1 or FIG. 2, the magnetic flux lines 26 exit the perforations 19, travel through payzone 2, and enter the perforations 19 on an opposing pole. In one test, a satisfactory magnetic flux field 26 was achieved by wiring two opposite coils 25 in series, then four other electromagnets were wired in parallel. A high voltage-low amperage pulsating DC current was then introduced into the electric circuit. The overall length of the apparatus 22 will vary with the length of the payzone 2. The casing 4 will have perforations 19 and electromagnets 25 spaced along the length of payzone 2. The apparatus 22 is placed in the production tubing 7 so that it is opposite the payzone 2. Also, sections of casing 4 in the payzone 2 may be reperforated 19 or cut away by cutting tools.

In another version of the invention, a capacitor 21 is introduced into the electrical circuit as shown in FIG. 2 and FIG. 3. This capacitor 21 will store and intermittently discharge electricity to the electromagnet, resulting in bursts of magnetic forces further stimulating flow. If pulsating current is supplied to the apparatus, the capacitor 21 charges instantaneously, then discharges through the coil 25. Collapsing lines of force cause the coil 25 to act like a generator for a short time.

Electromagnetic coils 25 and electromagnetic radiation will produce sound waves that will spread through the formation's solids, liquids and gases. Formation liquids and solids are better conductors of sound than the gases.

Figure 6:
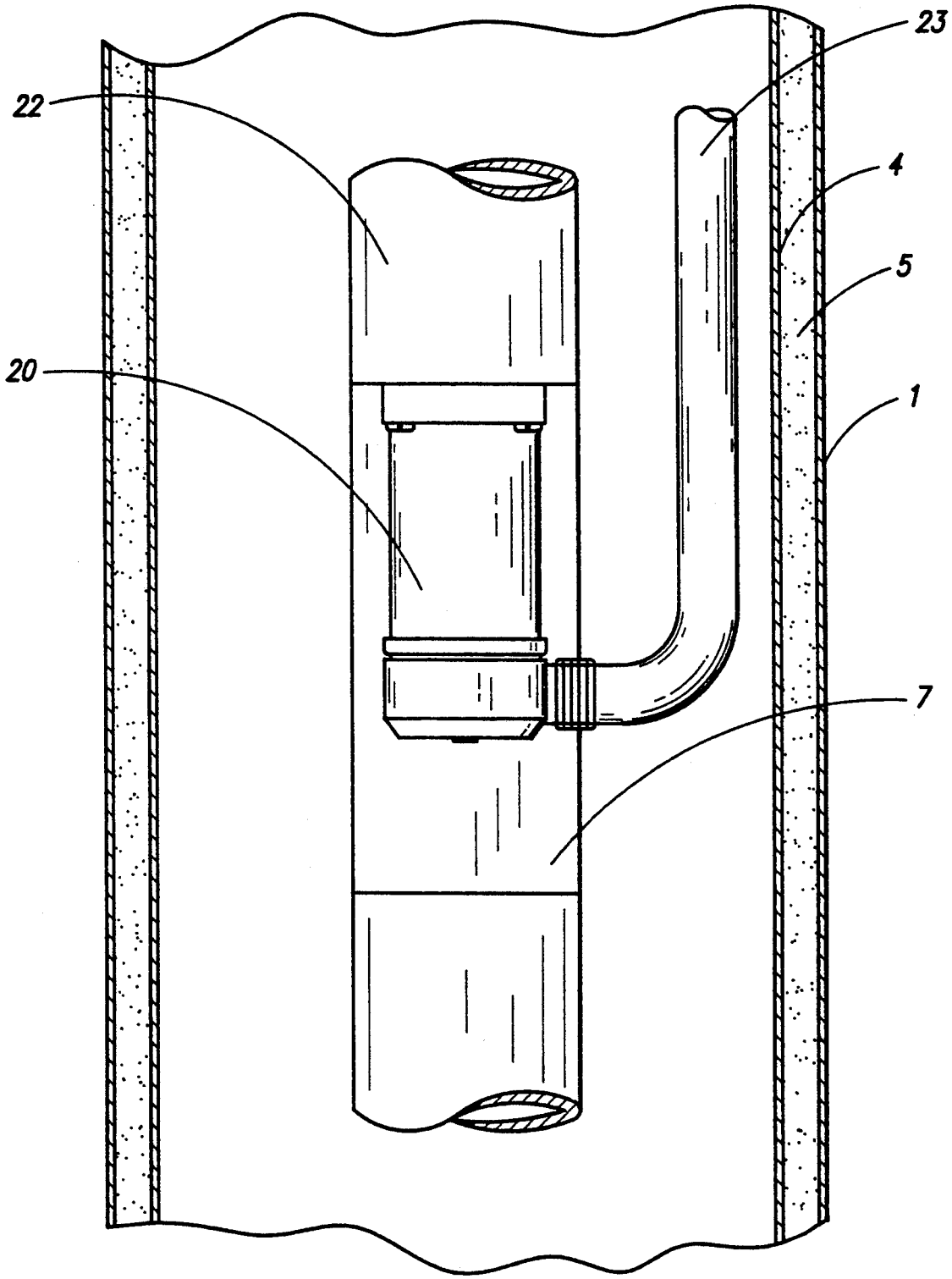
FIG. 6 is an elevational view of an optional vibration transducer placed below the electromagnetic coil apparatus on the well's tubing in the wellbore.

In vibrational energy, a current will oscillate for a time at a given frequency in a tuned circuit when a voltage is applied across that circuit only for an instant. Solids in the formation have such an abundance of frequencies of excitation possible that excitations in solids and liquids may be transferred to thermal vibrations or produce other physical or chemical changes. In a variation of the invention, vibration transducers 20 (referring to FIG. 6) on the tubing 7 in the wellbore 1 can be added to transform vibrations of the tubing into electricity. In some installations, vibration transducers 20 can be used to power the electromagnetic coils 25.

In still another variation of the invention, a piezoelectric material can be made a part of the electromagnetic coil 25 that is placed in the wellbore 1 (FIGS. 1, 2, 3 or 4).

Barium titanate and similar materials are piezoelectric materials. These materials are also designated as ferroelectric which are able to produce an electric charge and electrostrictive (changing shape with an electric charge). Quartz, existing in the formations of the reservoir, is a piezoelectric crystal that develops positive and negative charges on alternate prism edges when it is subject to pressure or tension. Pulsating electrical currents cause a pressure and following the release of the pressure, produce an opposite charge on the quartz edges. Expansion and contraction will cause quartz to vibrate. These vibrations will move through the formation. Vibration energy will aid in maintaining the temperature of the formation. The vibrations are transmitted very efficiently through the tubing 7 wall to the liquid medium in the tubing 7 and casing 4 and into the formation.

Cavitation causes increased liquid motion because of intense physical agitation. The cold boiling of cavitation appear to step up chemical activity and cause increased molecular motion. In cavitating fluids, opposite electrical charges occur on the opposite walls of the cavity. As a result of cavitation caused by the piezoelectric material, fluid flow is further stimulated by the apparatus.

The amount of energy required for cavitation varies, more viscous liquids require more power, also more power is required as liquid depth increases. At low frequencies, as in pulsating DC electrical currents, cleaning action is better because wavelengths are longer and the sound waves bend around the corners.

The mechanics of the installation of the apparatus 22 (FIG. 3), in a well are: Tubing 7 (FIG. 1) insulated from the production casing by non-conducting electrical spacers 14, is placed in the wellbore 1 of an oil 10 or gas 13 well in a manner so that the top of the tubing is separated by insulation 15 from the wellhead and other surface equipment. Electricity is supplied to the electromagnets 25 by means of a circuit consisting of the saline formation water and an insulated wire. The external electric power requirements are supplied and controlled by equipment and panels 17 on the surface near the wellbore 1 and are connected to the tubing 7 and to the casing 4 by electric cable 18.

Electrical energy is connected to the tubing 7 and the casing 4 at the surface or electrical energy is generated by vibration transducers 20 (FIG. 6), which causes electrical current to flow through the tubing 7 and casing 4 or a combination of tubing 7, rods 8 and casing 4. The current may flow through an insulated wire or an outside ground 27. Flowing current will actuate the electromagnetic coils 25. The vibration transducer 20 can also supply electrical energy from vibration of the tubing 7 when the well is pumping in one version of the invention.

Electromagnetic coils 25 are placed in the wellbore 1 inside the casing 4 on or in the tubing 7 just below the production pump 9; the coils 25 will be covered by fluid to assist in avoiding excessive heating of the electromagnetic coils 25 which would destroy the self-alignment capabilities of magnetic dipoles. The electromagnetic coils 25 are mounted perpendicular to the tubing 7 facing the formation of the reservoir in one version of the invention.

Figure 7:
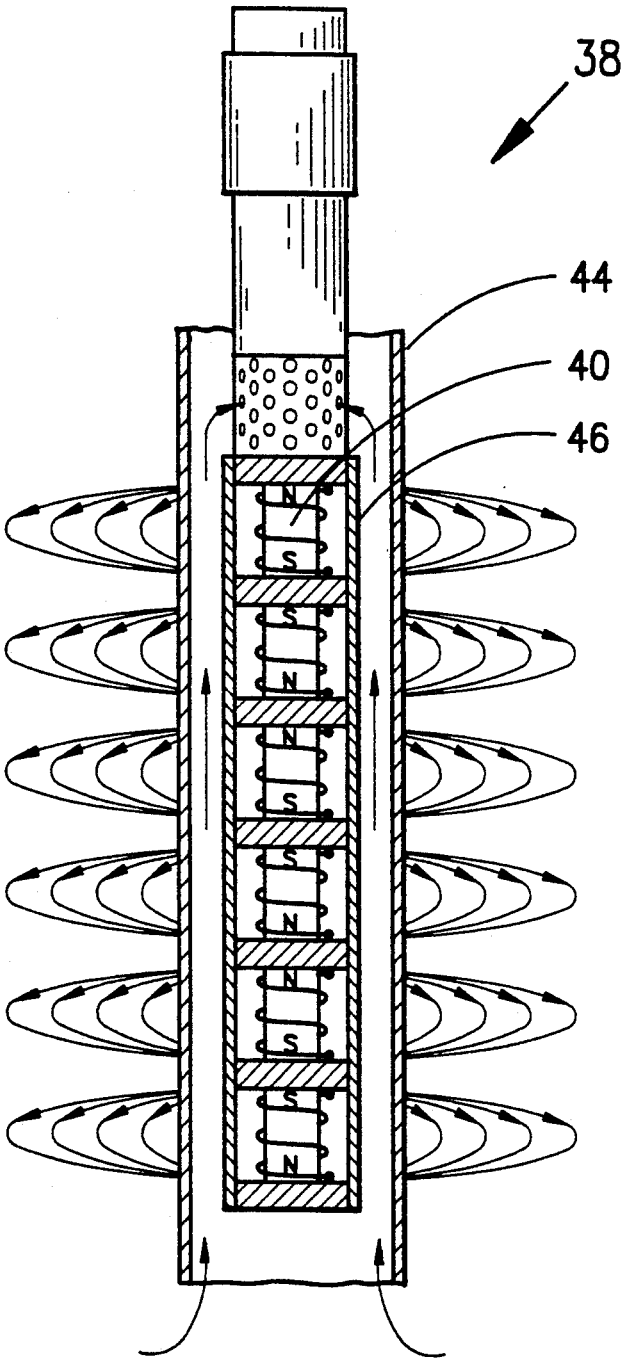
FIG. 7 is a sectional view of an alternate embodiment of the present invention.
Figure 8:
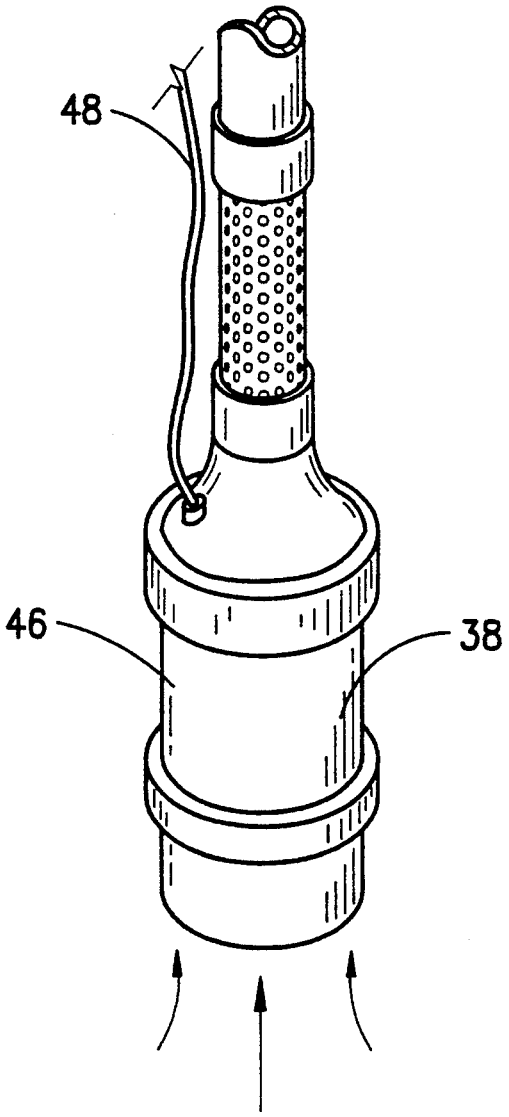
FIG. 8 is a perspective view of the embodiment shown in FIG. 1.

In an alternate version, as shown in FIGS. 7, 8 and 9, the coils 25 are oriented vertically attached to tubing 7. When electric current is applied (FIG. 4), an electric current flowing in the tubing 7 activates the electromagnetic coils 25 sending electromagnetic forces through the casing perforation 19 and/or into the open hole, into the payzone 2 formation and establishing the electromagnetic field (FIG. 4).

As this strong electromagnetic field is induced, a strong motive force is generated to increase flow of fluids.

The strong electromagnetic field will have strong lines of flux. These lines are continuous, forming closed loops, emerging from the north-seeking pole, fanning out and around and entering the south-seeking pole through the coils again and out the north-seeking pole.

As the ever expanding electromagnetic field, with its strong lines of flux, pass the random static magnetic domains in the formation, there is a large movement of domains, and the direction of magnetization in the domains gradually rotates as the field is increased until the magnetization is everywhere parallel to the field. Many millions of atoms spontaneously lock on the same alignment to form a domain that constitutes a magnetic dipole. When free to rotate, dipoles align themselves so that their moments point in the direction of the external magnetic field 26, this being the electromagnetic coil 25 in the casing 4 of the wellbore 1. The magnetic lines of flux 26 (FIG. 5) moving through the area produces movement of the fluids in the formation and in the conductors, the pores and the fractures 12. The conductors 12 will be larger near the wellbore 1, reducing the resistance, which will allow the fluids freer movement.

As all of the above phenomenons occur there will be movement of the formation fluids to the magnetic source, the electromagnetic coils 25 in the wellbore 1. As stated, there will be a gradual turning of the magnetic domains which will move, being attracted, along the formation conductors, pores and fractures 12. In an ever increasing manner, free electrons and ions, atoms and molecules will move in the ever larger conductors 12 following the lines of flux to the attracting force in the wellbore 1. As the formation fluids reach the wellbore 1, the liquids are produced up the tubing and on to the fluid separation point and the gases 13 will rise up the annulus of the casing 4 to the gas collecting line.

Electromagnetic Coil Apparatus 22, by making small adjustments to the magnetic field 26 in the well's chaotic reservoir, will increase flow of reservoir fluid to wellbore 1.

Applicant's process and apparatus, as presented, applies to petroleum fluids and also applies to the attraction of other types of fluids in different types of reservoirs.

Recent studies relating to anomalous magnetism associated with hydrocarbon deposits, "*Causes and Spatial Distribution of Anomalous Magnetism in Hydrocarbon Seepage Environments*", Machel, A. G. & Burton, *Bulletin American Association Petroleum Geologists,* Volume 75, No. 12, pages 1864–1876; December 1991 and "*Use of Magnetic Fields Aids Oil Search*", Foote, R. S. *Oil & Gas Journal,* May 4, 1992, provide background for the increased production of oil which is realized by applicant's process and apparatus.

These new studies illustrate how hydrocarbon fluids can assume increased magnetic properties upon movement through underground formations. These changes are caused by geochemical and microbial processes. As examples, low magnetic iron pyrite becomes magnetic greigite ($Fe_2S_2$) by the action, it is believed, of magnetotactic bacteria. The less magnetic hematite is changed to more magnetic forms of iron oxide such as magnetite or pyrrhotite.

The aforementioned studies were made to illustrate how anomalous magnetism can be used to aid in the location of subterranean oil deposits. These studies are cited here to show how magnetic properties become associated with subterranean oil deposits, Applicant's electromagnetic process and apparatus utilizes these magnetic properties of subterranean oil to cause oil to be attracted to the wellbore which results in increased production of oil.

Particles with a neutral magnetic charge can also be attracted by a magnetic field ("Laser Trapping of Neutral Particles," Chu. S. *Scientific American,* February 1992. A particle in a magnetic field will be drawn toward the region of the strongest field if the south pole of the particle points towards the north pole of the field. Particles need not be strongly magnetically susceptible to be attracted to the well casing by Applicant's electromagnetic process and apparatus.

Applicant's electromagnetic process and apparatus acts upon solid particles which are present in subterranean oil deposits. The solid particles present in the subterranean oil deposits are caused to move towards the wellbore by Applicant's apparatus. Oil (hydrocarbon) is pulled and pushed towards the wellbore as a result of the movement of these solid particles. Small droplets of oil coalesce to larger droplets as they are attracted to and approach the wellbore. By this action, oil which has lain static in the subterranean formation coalesces to a stream of liquid hydrocarbon moves to the wellbore and is transported to the surface as increased production.

FIG. 7 illustrates a sectional view of an alternate embodiment of the present invention. The electromagnetic coils 40 are axially aligned with each other and axially aligned with the rod. Fluid and particles which have been attracted to the coil will pass outside of the coils 40 within the casing 44. Passage of the fluid will assist in keeping the electromagnetic coils cool and not heating unduly.

FIG. 8 is a perspective view of the embodiment shown in FIG. 7. The entire electromagnetic coil apparatus 38 resides within a shell 46. Electric current to the device is supplied by a power line 48 from the surface. A perforated nipple may be provided above the apparatus to allow gas within the fluid to escape.

FIG. 9 illustrates a further, alternate embodiment 60 of the present invention. The electromagnetic coils 62 are axially aligned with each other and axially aligned with the rod. Fluid which is pumped and magnetically attracted is drawn up through the inside of the core past the electromagnetic coil 62. This serves to retain the coils from overheating.

A specific best mode process and apparatus has been described and illustrated for this invention in these preferred embodiment; but, it is to be understood that the same may be varied within the scop of the appended claims without departing from the spirit of the invention.

What is claimed is:

1. An apparatus to extract magnetically susceptible fluids and magnetically susceptible particles from a subterranean well having a shaft or tube extending from the surface to a fluid-containing formation and means to deliver said fluids and particles to the surface from said fluid-containing formation, which comprises:

a) at least one electromagnetic coil within said shaft or tube;

b) means to supply a direct current to said electromagnetic coil to generate an electromagnetic field in said fluid containing formation; and c) means to attract said magnetically susceptible fluids and particles toward said shaft or tube with said electromagnetic field.

2. An apparatus to extract magnetically susceptible fluids and particles as set forth in claim 1 wherein said direct current is supplied intermittently.

3. An apparatus to extract magnetically susceptible fluids and particles as set forth in claim 1 including a series of electromagnetic coils axially aligned within said tube or bore.

4. A process to extract magnetically susceptible fluids and magnetically susceptible particles from a subterranean well having a shaft or tube extending from the surface to a fluid-containing formation and means to deliver the fluids and particles to the surface from said fluid-containing formation, the process comprising:

a) inserting at least one electromagnetic coil within the shaft or tube;

b) supplying a direct current to said electromagnetic coil to generate an electromagnetic field in said fluid-containing formation;

c) intermittently reversing the direction of said direct current; and d) attracting said magnetically susceptible fluids and particles toward said shaft or tube with said electromagnetic field.

5. An apparatus to extract magnetically susceptible fluids and magnetically susceptible particles from a subterranean well having a shaft or tube extending from the surface to a fluid-containing formation and means to deliver said fluids and particles to the surface from said fluid-containing formation, which comprises:

a) at least one electromagnetic coil within said shaft or tube;

b) means to supply an intermittently reversed direct current to said electromagnetic coil to generate an electromagnetic field in said fluid containing formation; and c) means to attract said magnetically susceptible fluids and particles toward said shaft or tube with said electromagnetic field.

6. An apparatus to extract magnetically susceptible fluids and particles as set froth in claim 5 wherein said direct current is supplied intermittently.

7. An apparatus to extract magnetically susceptible fluids and particles as set forth in claim 5 including a series of electromagnetic coils axially aligned within said tube bore.

* * * * *